US009181724B2

(12) United States Patent
Kim

(10) Patent No.: US 9,181,724 B2
(45) Date of Patent: Nov. 10, 2015

(54) AUTOMATIC TENT FRAME

(71) Applicant: Young Sub Kim, Seoul (KR)

(72) Inventor: Young Sub Kim, Seoul (KR)

( * ) Notice: Subject to any disclaimer, the term of this patent is extended or adjusted under 35 U.S.C. 154(b) by 0 days.

(21) Appl. No.: 14/551,777

(22) Filed: Nov. 24, 2014

(65) Prior Publication Data

US 2015/0144168 A1 May 28, 2015

(30) Foreign Application Priority Data

Nov. 25, 2013 (KR) ..... 10-2013-0143478

(51) Int. Cl.

| | |
|---|---|
| ***E04H 15/44*** | (2006.01) |
| ***E04H 15/34*** | (2006.01) |
| ***E04H 15/28*** | (2006.01) |
| ***E04H 15/32*** | (2006.01) |
| ***E04H 15/42*** | (2006.01) |

(52) U.S. Cl.

CPC ..... *E04H 15/34* (2013.01); *E04H 15/28* (2013.01); *E04H 15/32* (2013.01); *E04H 15/42* (2013.01)

(58) Field of Classification Search

CPC ..... E04H 15/36; E04H 15/42; E04H 15/48; E04H 15/28

USPC ..... 135/128, 133, 135, 147, 98, 156

See application file for complete search history.

(56) References Cited

U.S. PATENT DOCUMENTS

| | | | | |
|---|---|---|---|---|
| 2,864,389 | A * | 12/1958 | Smith et al. | 135/98 |
| 6,230,728 | B1 * | 5/2001 | Reese | 135/98 |
| 6,354,316 | B1 * | 3/2002 | Chen | 135/100 |
| 7,509,967 | B2 * | 3/2009 | Kim | 135/135 |
| 7,607,447 | B1 * | 10/2009 | Han | 135/135 |
| 8,047,218 | B1 * | 11/2011 | Shin | 135/135 |
| 2006/0016467 | A1 * | 1/2006 | Bae | 135/98 |

FOREIGN PATENT DOCUMENTS

| | | | | |
|---|---|---|---|---|
| KR | 200361483 | Y | 8/2004 | |
| KR | 1020110119593 | | 11/2011 | |
| KR | 101191046 | * | 10/2012 | E04H 15/44 |

* cited by examiner

*Primary Examiner* — Noah Chandler Hawk

(74) *Attorney, Agent, or Firm* — Hamre, Schumann, Mueller & Larson, P.C.

(57) ABSTRACT

The present invention relates to an automatic tent frame capable of preventing an upper coupler and a lower coupler from being rotated with respect to each other or preventing given gaps from being generated on the coupled portions of the upper coupler and the lower coupler even in a case where an automatic tent is not unfolded to its original shape by the reduction of the restoring force of an extension spring and thus falls down due to external impacts like wind, thus preventing support poles supporting main poles from being damaged to extend the life span of the automatic tent frame, and capable of reducing the length of a pipe module, while allowing the pipe module to have the same functions as in conventional one, thus upwardly lifting an outer surface of the automatic tent by the reduced length to increase the interior of the automatic tent by a maximum height.

4 Claims, 7 Drawing Sheets

AUTOMATIC TENT FRAME

BACKGROUND OF THE INVENTION

1. Field of the Invention

The present invention relates to an automatic tent frame having an extension spring extended when an automatic tent is folded, and more particularly, to an automatic tent frame that is capable of preventing an upper coupler and a lower coupler from being rotated with respect to each other or preventing given gaps from being generated on the coupled portions of the upper coupler and the lower coupler even in a case where an automatic tent is not unfolded to its original shape by the reduction of the restoring force of an extension spring and thus falls down due to external impacts like wind, thus preventing support poles supporting main poles from being damaged to extend the life span of the automatic tent frame, and that is capable of reducing the length of a pipe module, while allowing the pipe module to have the same functions as in conventional one, thus upwardly lifting an outer surface of the automatic tent by the reduced length to increase the interior of the automatic tent by a maximum height and providing very pleasant camping in the relatively extended internal space of the automatic tent.

2. Background of the Related Art

Modern people, who want to live comfortably in nature like mountains and river, away from busy schedules, have enjoyed their camping as one of their endevours to improve their quality of life.

Camping means with modern facilities such as a camping car, a forest park, a bungalow and the like have been developed, but among them, one of the best camping means is an automatic tent capable of realizing the real value of nature and learning the wisdom of life in nature.

However, it is not easy to find an appropriate area for camping, install the automatic tent, and remove the automatic tent, and particularly, it is very hard for women or children to do such works. Accordingly, various developments for an automatic tent frame capable of easily installing and removing the automatic tent have been dynamically made as will be mentioned below.

In this case, an automatic tent is a new tent capable of being installed and removed in a rapid and convenient way, and as shown in FIG. 6, the automatic tent T includes an automatic tent frame 1 forming a frame structure thereof and an outer surface 2 fitted to the outside of the automatic tent frame 1 to shield the automatic tent from rain and wind. The automatic tent T is installed by pulling outer surface loops 21 locked onto the automatic tent frame 1 through momentary unfolding of the automatic tent frame 1 and by unfolding the outer surface 2. The automatic tent is also called foldable tent or one touch tent, and one of the main features of the automatic tent T is the completion of installation and removal with a short period of time through just folding or unfolding, thus improving the convenience in use.

Of course, the outer surface 2 of the automatic tent T basically needs a water proofing function according to the exposure to ultraviolet rays and a flame resistance treatment for protecting a user from fire, but the automatic tent frame 1 basically should improve the easiness in the installation and removal of the automatic tent, maintain the stability of the installed tent, and enhance the conveniences in living in the automatic tent.

Recently, there has been proposed Korean Patent No. 10-1191046 entitled 'automatic tent frame', issued on Oct. 9, 2012 to the same inventor as the present invention, wherein the conventional automatic tent frame has an extension spring extended when an automatic tent is folded.

Referring to FIGS. 7 to 9, the above-mentioned conventional automatic tent frame will be in detail explained below. The automatic tent frame 500 includes: a pipe module 510 having two pipes having different diameters from each other, the small diameter pipe being insertedly fitted to the large diameter pipe in such a manner as to slidingly move therein; an upper coupler 520 located on top of the pipe module 510 in such a manner as to be coupled to any one of the two pipes of the pipe module 510; a lower coupler 530 located on the underside of the pipe module 100 in such a manner as to be coupled to the other pipe of the pipe module 510; an extension spring T inserted into the pipe module 510 in such a manner as to be fixed on the upper end periphery thereof to the pipe to which the upper coupler 520 is fixed and on the lower end periphery to the pipe to which the lower coupler 530 is fixed, the extension spring T being fixed in a state of being extended by a given length; a plurality of main poles F9 hinge-coupled to the upper coupler 520; and a plurality of support poles F10 each having one end hinge-coupled to the main pole F9 and the other end hinge-coupled to the lower coupler 530, wherein the extension spring T has an upper coupling end U and a lower coupling end L on which fastening holes H are formed, the upper end periphery of the extension spring T being fixed to the pipe to which the upper coupler 520 is fixed by means of a fastening member M passing through the upper coupler 520 and the pipe to which the upper coupler 520 is fixed in such a manner as to be inserted into the fastening hole H of the upper coupling end U, and the lower end periphery of the extension spring T being fixed to the pipe to which the lower coupler 530 is fixed by means of a fastening member M passing through the lower coupler 530 and the pipe to which the lower coupler 530 is fixed in such a manner as to be inserted into the fastening hole H of the lower coupling end U, and the lower coupler 530 has a through hole P formed on the underside thereof, the lower coupling end L of the extension spring T having an extension piece E exposed to the outside through the through hole P in such a manner as to allow the extension spring T to be extended by a given length L5 in an arrow direction C when the lower coupling end L of the extension spring T is fixed.

According to the above-mentioned conventional automatic tent frame, in the state where the extension spring is extended while the automatic tent frame is being not used for a long period of time, even if the automatic tent is unfolded, it can be completely unfolded to its initial expected shape.

As the time has passed, however, the extension force of the extension spring becomes weak, and further, the restoring force of the extension spring becomes reduced, so that the automatic tent is not unfolded to its initial shape and thus falls down due to the external impacts like wind. Furthermore, the upper coupler and the lower coupler are rotated with respect to each other, and given gaps are undesirably generated on the coupling portions of the upper coupler and the lower coupler, thus causing the support poles supporting the main poles to be turned and damaged to shorten the life span of the automatic tent frame. Accordingly, separate locking means should be needed.

Additionally, the height of the head portion formed by coupling the upper coupler, the pipe module and the lower coupler with each other is relatively high in the whole height of the installed automatic tent, but the height of the internal space of the automatic tent is not relatively high, which causes many inconveniences in standing or moving in the interior of the automatic tent.

SUMMARY OF THE INVENTION

Accordingly, the present invention has been made in view of the above-mentioned problems occurring in the prior art, and it is an object of the present invention to provide an automatic tent frame that is capable of preventing an upper coupler and a lower coupler from being rotated with respect to each other or preventing given gaps from being generated on the coupled portions of the upper coupler and the lower coupler, without having any separate locking means, even in a case where an automatic tent is not unfolded to its original shape by the reduction of the restoring force of an extension spring and thus falls down due to external impacts like wind, thus preventing support poles supporting main poles from being damaged to extend the life span of the automatic tent frame, and that is capable of reducing the length of a pipe module, while allowing the pipe module to have the same functions as in conventional one, thus upwardly lifting an outer surface of the automatic tent by the reduced length to increase the interior of the automatic tent by a maximum height and providing very pleasant camping in the relatively extended internal space of the automatic tent.

To accomplish the above-mentioned object, according to the present invention, there is provided an automatic tent frame including: a pipe module having a small diameter pipe and a large diameter pipe having different diameters from each other, the small diameter pipe being insertedly fitted to the large diameter pipe in such a manner as to be slidingly moved therein; an upper coupler having a small diameter pipe coupling groove formed at the center of the underside thereof in such a manner as to be located on top of the pipe module and coupled to the upper end periphery of the small diameter pipe by means of a first fastening member; a lower coupler having a large diameter pipe coupling groove formed at the center of the top thereof and a through hole formed at the center of the underside thereof in such a manner as to be located on the underside of the pipe module and coupled to the lower end periphery of the large diameter pipe by means of a second fastening member; an extension spring having an upper coupling end and a lower coupling end on which fastening holes are formed, an extension piece exposed to the outside through the through hole of the lower coupler in such a manner as to be pulled by a given length when the extension spring is fixed, the upper end periphery of the extension spring being insertedly fitted to the pipe module in such a manner as to be fixed to the small diameter pipe by means of the first fastening member passed through the upper coupler and the small diameter pipe to which the upper coupler is fixed and inserted into the fastening hole of the upper coupling end, and the lower end periphery of the extension spring being insertedly fitted to the pipe module in such a manner as to be fixed to the large diameter pipe by means of the second fastening member passed through the lower coupler and the large diameter pipe to which the lower coupler is fixed and inserted into the fastening hole of the lower coupling end; a plurality of main poles hinge-coupled to the upper coupler; and a plurality of support poles each having one end hinge-coupled to the main pole and the other end hinge-coupled to the lower coupler, wherein the small diameter pipe is open on the top and bottom thereof and has coupling holes formed facingly on the upper periphery thereof and long slots formed facingly on the lower end periphery thereof in a perpendicular direction to the coupling holes.

According to the present invention, desirably, each long slot has a given width through which the second fastening member is passed and a given length extended from the underside of the small diameter pipe to a higher position than the position where coupling holes are formed on the lower coupler to face the long slots when the small diameter pipe is coupled to the lower coupler.

According to the present invention, desirably, the extension piece exposed to the outside through the through hole of the lower coupler is coupled to an upper loop disposed on top of an outer surface of an automatic tent in such a manner as to be pulled together when the extension spring is contracted to increase a height of the automatic tent.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
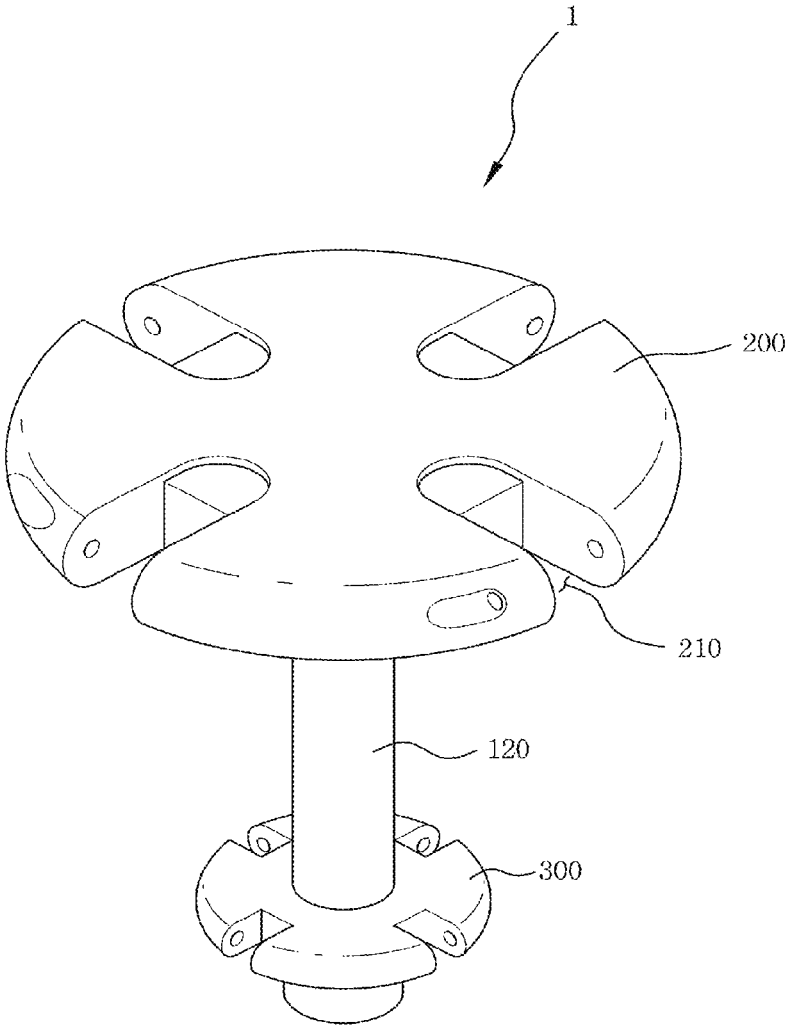
FIG. 1 is a perspective view showing an automatic tent frame according to the present invention.

Hereinafter, an explanation on an automatic tent frame according to the present invention will be in detail given with reference to the attached drawings.

In the description, the terms as will be discussed later are defined in accordance with the functions of the present invention, but may be varied under the intention or regulation of a user or operator. Therefore, they should be defined on the basis of the whole scope of the present invention. Before the present invention is disclosed and described, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill n the art to variously employ the present invention in virtually any appropriately detailed structure. The present invention is disclosed with reference to the attached drawings wherein the corresponding parts in the embodiments of the present invention are indicated by corresponding reference numerals and the repeated explanation on the corresponding parts will be avoided. If it is determined that the detailed explanation on the well known technology related to the present invention makes the scope of the present invention not clear, the explanation will be avoided for the brevity of the description.

Figure 2:
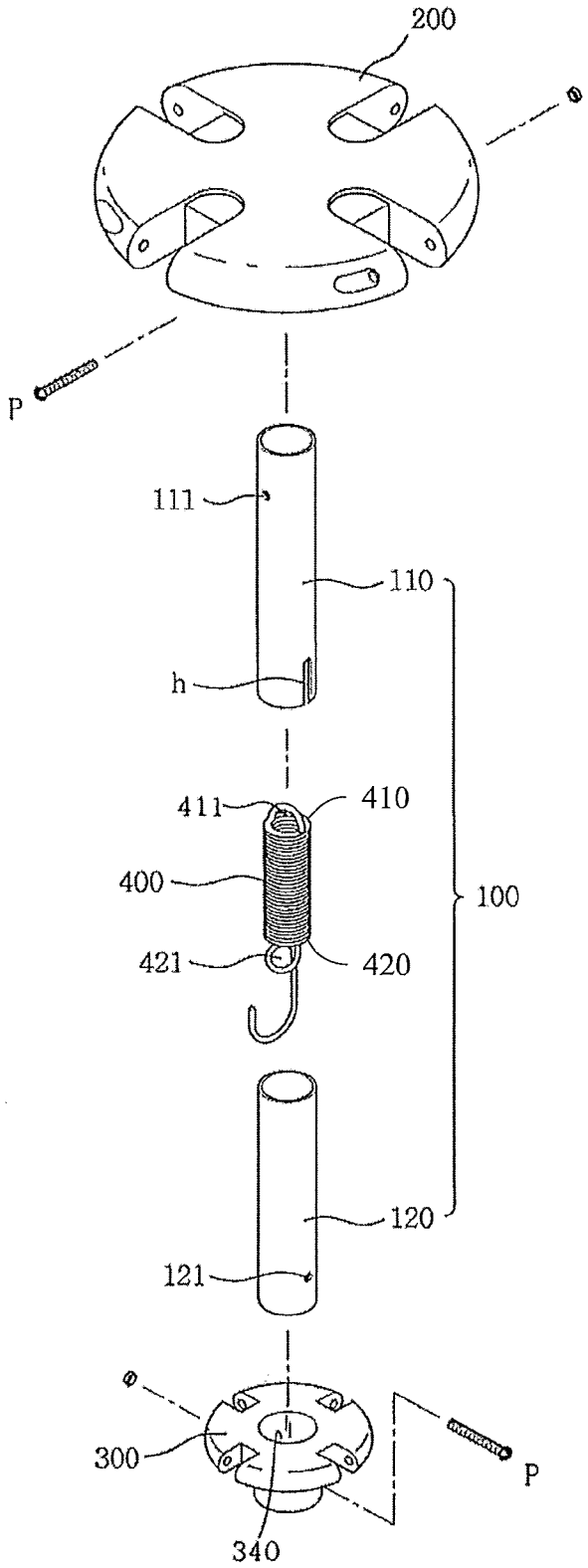
FIG. 2 is an exploded perspective view showing the automatic tent frame according to the present invention.
Figure 3:
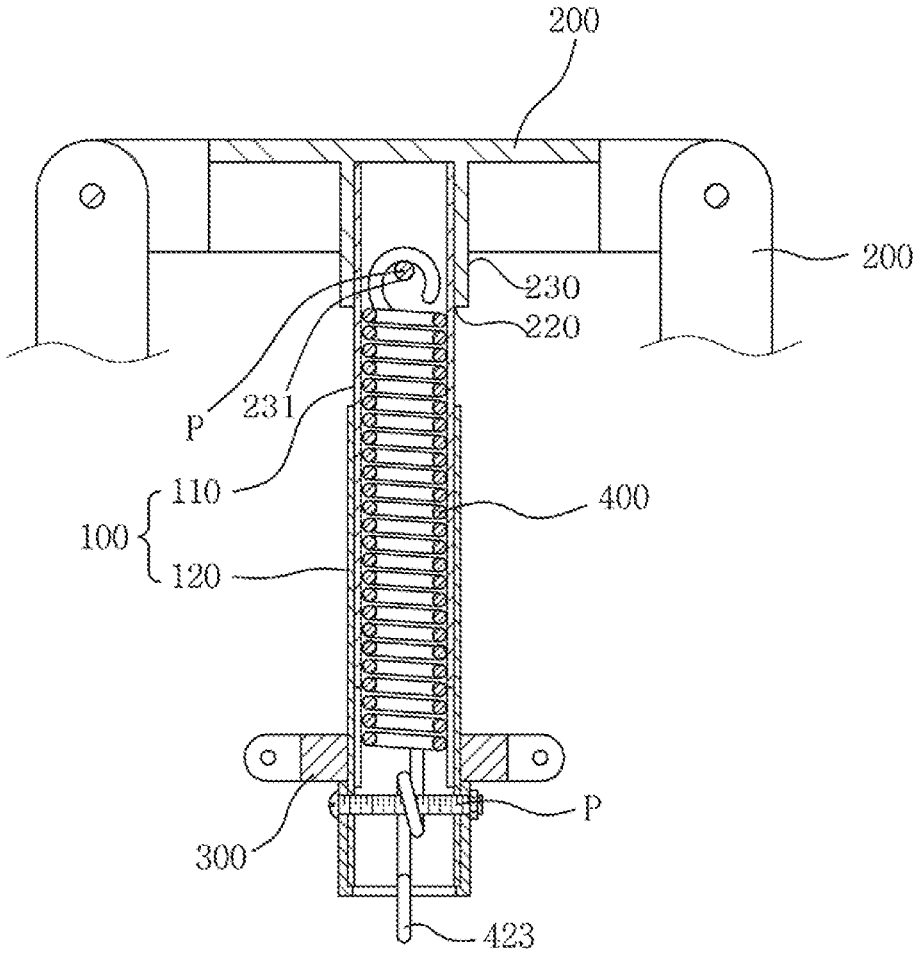
FIG. 3 is a sectional view showing the folded state of the automatic tent frame according to the present invention.
Figure 4:
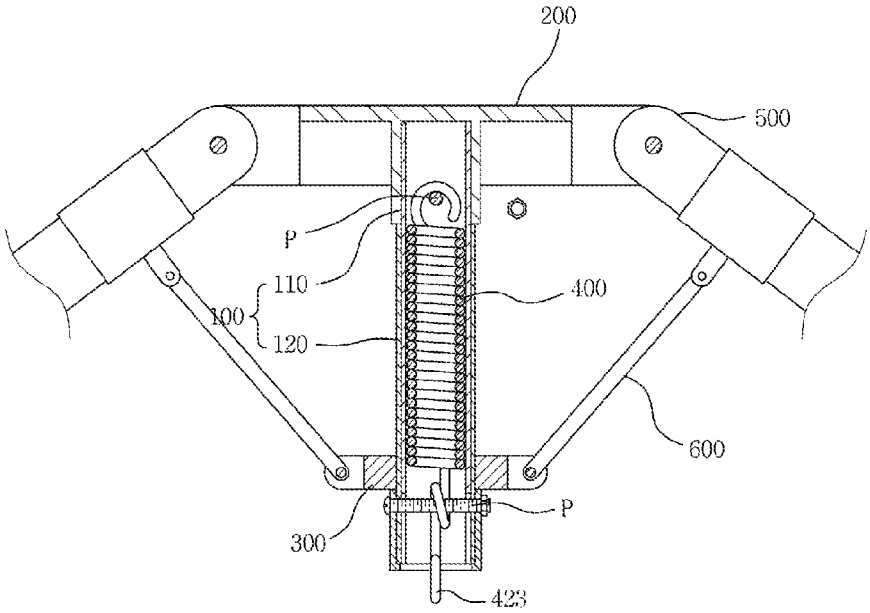
FIG. 4 is a sectional view showing the unfolded state of the automatic tent frame according to the present invention.
Figure 5:
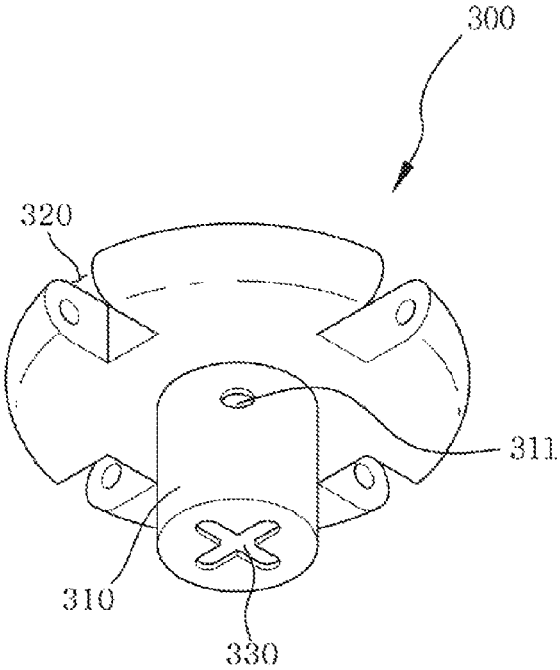
FIG. 5 is a perspective view showing a lower coupler of the automatic tent frame according to the present invention.
Figure 6:
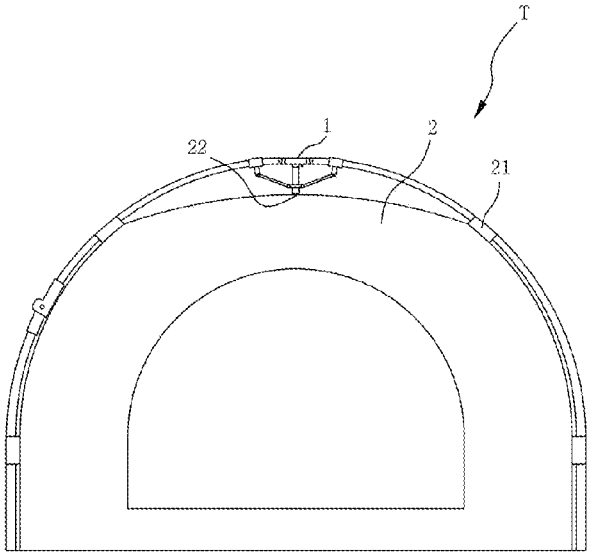
FIG. 6 is a schematic view showing an automatic tent mounted with the automatic tent frame according to the present invention.
Figure 7:
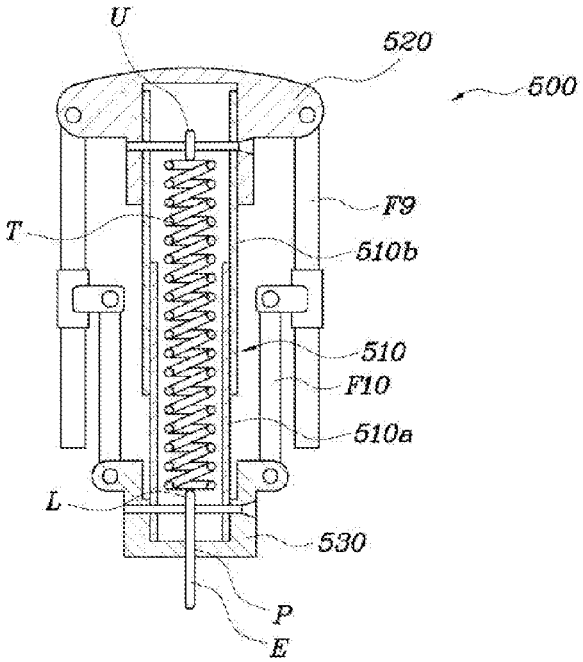
FIG. 7 is a sectional view showing the folded state of a conventional automatic tent frame.
Figure 8:
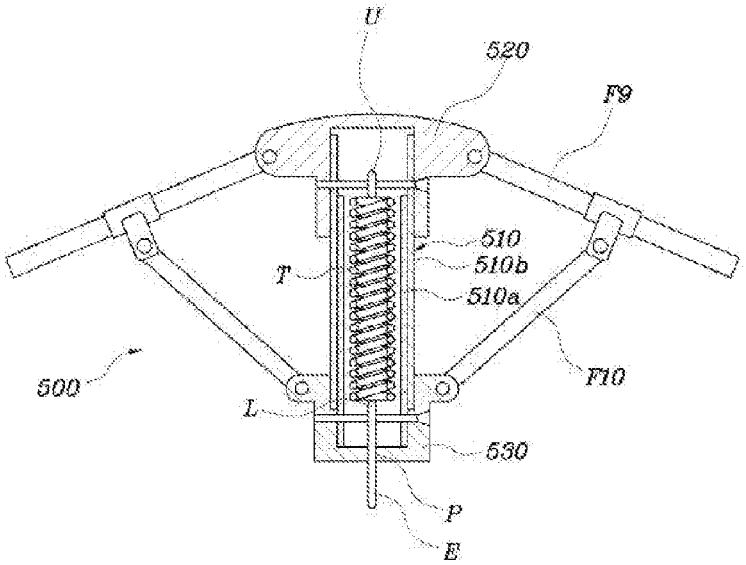
FIG. 8 is a sectional view showing the unfolded state of the conventional automatic tent frame.
Figure 9:
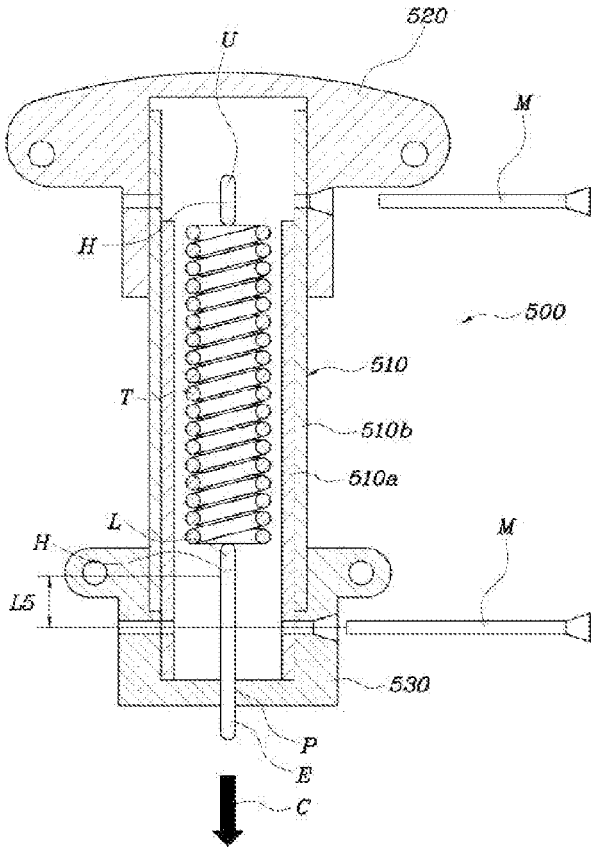
FIG. 9 is a sectional view showing the extended state of the conventional automatic tent frame.

FIG. 1 is a perspective view showing an automatic tent frame according to the present invention, FIG. 2 is an exploded perspective view showing the automatic tent frame according to the present invention, FIG. 3 is a sectional view showing the folded state of the automatic tent frame according to the present invention, FIG. 4 is a sectional view showing the unfolded state of the automatic tent frame according to the present invention, FIG. 5 is a perspective view showing a lower coupler of the automatic tent frame according to the present invention, and FIG. 6 is a schematic view showing an automatic tent mounted with the automatic tent frame according to the present invention.

As shown in FIGS. 1 to 6, an automatic tent frame 1 according to the present invention includes: a pipe module 100 having a small diameter pipe 110 and a large diameter pipe 120 having different diameters from each other, the small diameter pipe 110 being insertedly fitted to the large diameter pipe 120 in such a manner as to be slidingly moved therein; an upper coupler 200 having a small diameter pipe coupling groove 220 formed at the center of the underside thereof in such a manner as to be located on top of the pipe module 100 and coupled to the upper end periphery of the small diameter pipe 110 by means of a first fastening member p; a lower coupler 300 having a large diameter pipe coupling groove 340 formed at the center of the top thereof and a through hole 330 formed at the center of the underside thereof in such a manner as to be located on the underside of the pipe module 100 and coupled to the lower end periphery of the large diameter pipe 120 by means of a second fastening member p; an extension spring 400 having an upper coupling end 410 and a lower coupling end 420 on which fastening holes 411 and 421 are formed, an extension piece 423 exposed to the outside through the through hole 330 of the lower coupler 300 in such a manner as to be pulled by a given length when the extension spring 400 is fixed, the upper end periphery of the extension spring 400 being insertedly fitted to the pipe module 100 in such a manner as to be fixed to the small diameter pipe 110 by means of the first fastening member p passed through the upper coupler 200 and the small diameter pipe 110 to which the upper coupler 200 is fixed and inserted into the fastening hole 411 of the upper coupling end 410, and the lower end periphery of the extension spring 400 being insertedly fitted to the pipe module 100 in such a manner as to be fixed to the large diameter pipe 120 by means of the second fastening member p passed through the lower coupler 300 and the large diameter pipe 120 to which the lower coupler 300 is fixed and inserted into the fastening hole 421 of the lower coupling end 420; a plurality of main poles 500 hinge-coupled to the upper coupler 200; and a plurality of support poles 600 each having one end hinge-coupled to the main pole 500 and the other end hinge-coupled to the lower coupler 300, wherein the small diameter pipe 110 is open on the top and bottom thereof and has coupling holes 111 formed facingly on the upper periphery thereof and long slots h formed facingly on the lower end periphery thereof in a perpendicular direction to the coupling holes 111.

Further, each long slot h has a given width through which the second fastening member p is passed and a given length extended from the underside of the small diameter pipe 110 to a higher position than the position where coupling holes 311 are formed on the lower coupler 300 to face the long slots h when the small diameter pipe 110 is coupled to the lower coupler 300.

The extension piece 423 exposed to the outside through the through hole 330 of the lower coupler 300 is coupled to an upper loop 22 disposed on top of an outer surface 2 of an automatic tent in such a manner as to be pulled together when the extension spring 400 is contracted to increase a height of the automatic tent.

Hereinafter, the automatic tent frame 1 according to the present invention will be in detail explained.

As shown in FIG. 2, first, the pipe module 100 has the small diameter pipe 110 and the large diameter pipe 120 having different diameters from each other, and the small diameter pipe 110 is insertedly fitted to the large diameter pipe 120 in such a manner as to slidingly move therein. That is, the extension spring 400 is inserted into the small diameter pipe 110, and the open end portion of the small diameter pipe 110 coupled to the upper coupler 200 is movably inserted into the open end portion of the large diameter pipe 120 coupled to the lower coupler 300.

The small diameter pipe 110 is open on the top and bottom thereof and has the coupling holes 111 formed facingly on the upper periphery thereof and the long slots h formed facingly on the lower end periphery thereof.

Each long slot h has a larger width than the second fastening member p to pass the second fastening member p therethrough and the length extended from the underside of the small diameter pipe 110 to a higher position than the position where coupling holes 311 are formed on the lower coupler 300 to face the long slots h when the small diameter pipe 110 is coupled to the lower coupler 300. When the small diameter pipe 110 is insertedly fitted to the large diameter pipe 120, as a result, the second fastening member p is completely inserted into the long slots h of the small diameter pipe 110.

At this time, the long slots h are formed in the perpendicular direction to the coupling holes 111 facingly formed on the upper periphery of the small diameter pipe 110, so that the rotating gaps with respect to the upper coupler 200 and the lower coupler 300 can be even a little reduced desirably.

The upper end periphery of the small diameter pipe 110 is inserted into the small diameter pipe coupling groove 220 of the upper coupler 200 and coupled thereto by means of the first fastening member p passing sequentially through coupling holes 231 formed facingly on the outer peripheral surface of a small diameter pipe coupler 230 of the upper coupler 200, the coupling holes 111 formed on the upper periphery of the small diameter pipe 110, and the fastening hole 411 of the upper coupling end 410 of the extension spring 400.

At this time, the first fastening member p is a bolt finished by means of nut coupling, but it is not limited thereto. According to the present invention, the first and second fastening members p have the same kind and size as each other, which is advantageous in the assembling process.

The large diameter pipe 120 is open on the top and bottom thereof and has coupling holes 121 formed facingly on the lower periphery thereof.

The lower end periphery of the large diameter pipe 120 is inserted into the large diameter pipe coupling groove 340 of the lower coupler 300 and fastened thereto by means of the second fastening member p passing sequentially through the coupling holes 311 of the lower coupler 300, the coupling holes 121 of the large diameter pipe 120, the long slots h of the lower end periphery of the small diameter pipe 110, and the fastening hole 421 of the lower coupling end 420 of the extension spring 400.

Further, the upper coupler 200 has a shape of a disc having a plurality of main pole coupling grooves 210 formed along the outer periphery thereof and includes a pipe type small diameter pipe coupler 230 protruding unitarily from the center of the underside thereof, the small diameter pipe coupling groove 220 formed at the center of the underside of the small diameter pipe coupler 230, and the coupling holes 231 formed facingly on the outer peripheral surface of the small diameter pipe coupler 230.

The upper coupler 200 is located on top of the pipe module 100 in such a manner as to be coupled to the upper end periphery of the small diameter pipe 110 by means of the first fastening member p passing sequentially through the coupling holes 231 formed facingly on the outer peripheral surface of the small diameter pipe coupler 230, the coupling holes 111 formed on the upper periphery of the small diameter pipe 110, and the fastening hole 411 of the upper coupling end 410 of the extension spring 400 inserted into the small diameter pipe 110.

Further, the lower coupler 300 has a flange-shaped upper portion having a plurality of support pole coupling grooves 320 formed along the outer periphery thereof and a cylindrical large diameter pipe receiver 310 formed unitarily from the underside thereof in such a manner as to be open on top thereof, and the large diameter pipe receiver 320 has a "+"-shaped through hole 330 formed at the center of the underside thereof in such a manner as to allow the extension piece 423 of the extension spring 400 to be exposed to the outside therethrough.

The coupling holes 311 are formed facingly on the outer peripheral surface of the large diameter pipe receiver 320.

The lower coupler 300 is located on the underside of the pipe module 100 in such a manner as to be coupled to the lower end periphery of the large diameter pipe 120 by means of the second fastening member p passing sequentially through the coupling holes 311 formed on the outer peripheral surface of the large diameter pipe receiver 320 of the lower coupler 300, the coupling holes 121 formed on the lower periphery of the large diameter pipe 120, the long slots h of the lower end periphery of the small diameter pipe 110, and the fastening hole 421 of the lower coupling end 420 of the extension spring 400 inserted into the small diameter pipe 110.

At this time, the fastening is achieved by outwardly pulling the extension piece 423 exposed to the outside through the through hole 330 of the lower coupler 300 to allow the fastening hole 421 formed on the lower end of the extension spring 400 to be located correspondingly on the coupling holes 311 formed on the outer periphery of the large diameter pipe receiver 310 and the coupling holes 121 formed on the lower periphery of the large diameter pipe 120 and next by insertedly passing the second fastening member p therethrough. That is, the extension spring 400 becomes fixed in the state of being extended by a given length.

Of course, the small diameter pipe 110 and the large diameter pipe 120 may be changeably coupled to the upper coupler 200 and the lower coupler 300.

Further, the small diameter pipe 110, the large diameter pipe 120, the upper coupler 200 and the lower coupler 300 are made of any one selected from a metal material and a synthetic resin material, and particularly, only if the small diameter pipe 110 and the large diameter pipe 120 have the sectional shapes corresponding to each other, they have various sections such as circular, oval, and polygonal sections.

Figure 10:
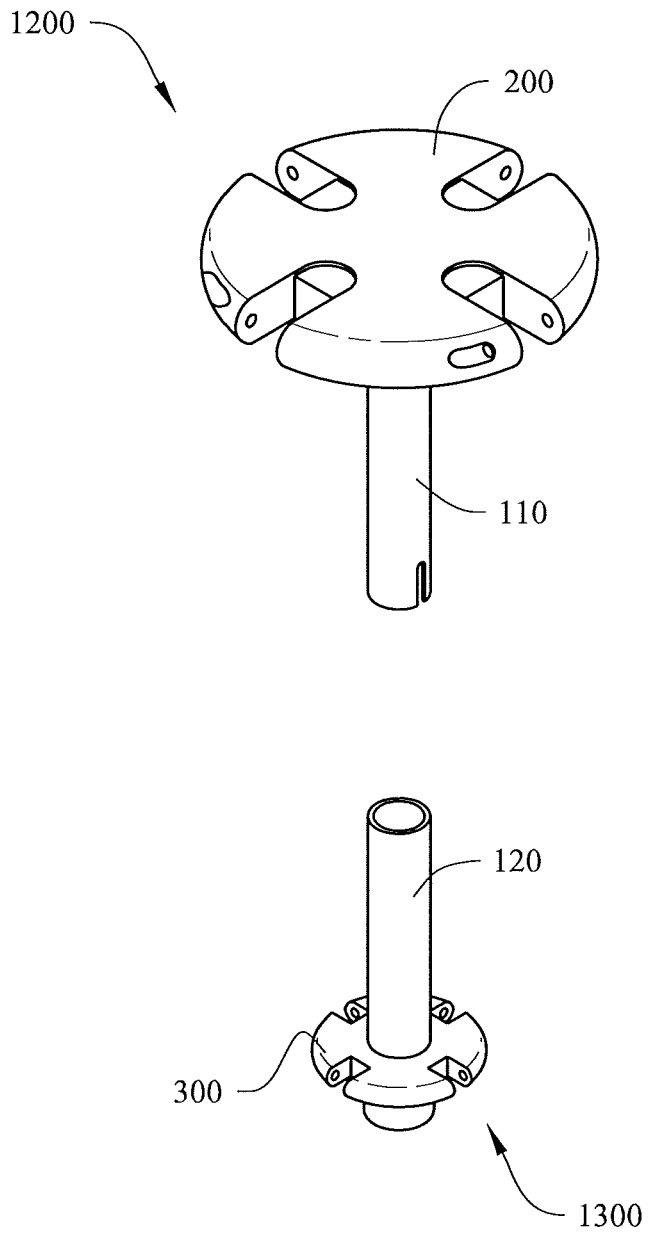
FIG. 10 is a perspective view showing another embodiment of the automatic tent frame according to the present invention.

FIG. 2 shows the small diameter pipe 110, the large diameter pipe 120, the upper coupler 200 and the lower coupler 300 disposed independently of each other, as respective components. However, as shown in FIG. 10, the small diameter pipe 110 and the upper coupler 200 may be formed unitarily 1200 with each other, while the large diameter pipe 120 and the lower coupler 300 being formed unitarily 1300 with each other. Of course, the small diameter pipe 110 and the large diameter pipe 120 may be changeably formed unitarily with the upper coupler 200 and the lower coupler 300.

The extension spring 400 has the upper coupling end 410 and the lower coupling end 420 on which the fastening holes 411 and 421 are formed.

The extension spring 400 further has the extension piece 423 disposed on the lower end thereof in such a manner as to be exposed to the outside through the through hole 330 of the lower coupler 300, so that the extension piece 423 is pulled by a given length to allow the extension spring 400 to be easily fixed.

The upper end periphery of the extension spring 400 is insertedly fitted to the pipe module 100 and fixed to the small diameter pipe 110 by means of the first fastening member p passed through the upper coupler 200 and the small diameter pipe 110 to which the upper coupler 200 is fixed and inserted into the fastening hole 411 of the upper coupling end 410.

The lower end periphery of the extension spring 400 is insertedly fitted to the pipe module 100 and fixed to the large diameter pipe 120 by means of the second fastening member p passed through the lower coupler 300 and the large diameter pipe 120 to which the lower coupler 300 is fixed and inserted into the fastening hole 421 of the lower coupling end 420.

Further, as shown in FIG. 4, the plurality of main poles 500 is well known components, and they are hinge-coupled to the plurality of main pole coupling grooves 210 formed on the outer periphery of the upper coupler 200. The plurality of support poles 600 is well known components, and they are hinge-coupled to the main poles 500 at their one end and hinge-coupled to the lower coupler 300 at their other end. The configurations of the main poles 500 and the support poles 600 and their hinge coupling structures are well known in the art, and therefore, a detailed explanation on them will be avoided for the brevity of the description.

Now, an explanation on the operation of the automatic tent frame 1 according to the present invention will be in detail given.

The small diameter pipe 110 is insertedly fitted to the upper coupler 200, and next, the extension spring 400 is inserted into the small diameter pipe 110. After that, the first fastening member p is passed sequentially through the coupling holes 231 of the upper coupler 200, the coupling holes 111 of the small diameter pipe 110, and the fastening hole 411 of the upper coupling end 410 of the extension spring 400, thus fastening the extension spring 400 to the small diameter pipe 110. Next, the large diameter pipe 120 is fitted to the outer peripheral surface of the small diameter pipe 110, and next, the lower coupler 300 is insertedly fitted to the lower end periphery of the large diameter pipe 120. After that, the second fastening member p is passed sequentially through the coupling holes 311 of the lower coupler 300, the coupling holes 121 of the large diameter pipe 120, the long slots h of the small diameter pipe 110, and the fastening hole 421 of the lower coupling end 420 of the extension spring 400, thus fastening the extension spring 400 to the large diameter pipe 120. Next, the plurality of main poles 500 is hinge-coupled to the plurality of main pole coupling grooves 210 formed on the outer periphery of the upper coupler 200, and the plurality of support poles 600 is hinge-coupled to the main poles 500 at their one end and hinge-coupled to the lower coupler 300 at their other end, thus finishing the formation of the automatic tent frame 1.

Next, the main poles 500 of the automatic tent frame 1 are fitted to outer surface loops 21 of the outer surface 2 of the automatic tent T, and the extension piece 423 of the extension spring 400 exposed to the outside through the through hole 330 of the lower coupler 300 is coupled to the upper loop 22 of the outer surface 2 of the automatic tent T. In this state, the whole automatic tent T is folded and packaged, thus finishing the assembling and packaging of the automatic tent T. At this time, the automatic tent T is folded in the state where the extension spring 400 is extended.

On the other hand, if the upper loop 22 of the outer surface 2 of the automatic tent T, which is coupled to the extension piece 423 of the extension spring 400 exposed to the outside through the through hole 330 of the lower coupler 300, is momentarily pulled upward by means of the instant contraction of the extension spring 400 of the automatic tent frame 1, the main poles 500 are momentarily unfolded by means of the instant contraction of the extension spring 400 of the automatic tent frame 1 to instantly pull the outer loops 21 of the outer surface 2 fitted to the main poles 500, thus folding the outer surface 2 of the automatic tent T and installing the automatic tent T within a short period of time.

If it is desired to install the automatic tent T after an automatic tent installation area is found, that is, the main poles 500 are just pulled once toward both sides, so that the extended extension spring 400 of the automatic tent frame 1 is released from the balanced state and momentarily contracted. As shown in FIGS. 4 and 6, the upper loop 22 of the outer surface of the automatic tent T, which is coupled to the extension piece 423 of the extension spring 400 exposed to the outside through the through hole 330 of the lower coupler 300, is momentarily pulled upward, and at the same time, the lower coupler 300 coupled to the lower end periphery of the extension spring 400 is pulled upward, thus allowing one ends of the support poles 600 hinge-coupled to the support pole coupling grooves 320 formed the flange-shaped outer periphery of the upper portion of the lower coupler 300 to be momentarily pulled and thus allowing the main poles 500 to be momentarily pushed outward and unfolded by means of the other ends of the support poles 600, so that the outer surface loops 21 fitted to the main poles 500 are pulled to unfold the outer surface 2 of the automatic tent T, thus installing the automatic tent T.

At this time, if the extension spring 400 is contracted, as shown in FIG. 4, the lower end periphery of the small diameter pipe 110 is brought into contact with the bottom surface of the lower coupler 300, and the second fastening member p is inserted into the long slots h formed on the lower end periphery of the small diameter pipe 110, so that a locking effect is generated from the small diameter pipe 110 through the second fastening member p to prevent the rotation or gap between the small diameter pipe 110 and the large diameter pipe 120 from being generated. Even if the automatic tent T falls down due to the application of an unexpected external pressure thereto, accordingly, no rotation or gap between the upper coupler 200 to which the small diameter pipe 110 is coupled and the lower coupler 300 to which the large diameter pipe 120 is coupled, thus preventing the support poles 600 supporting the main poles 500 from being damaged and further extending the life span of the automatic tent frame 1.

In the conventional practice, if the extension spring 400 is contracted, the lower end periphery of the small diameter pipe 110 is locked to the second fastening member p of the lower coupler 300, so that the height of the head portion formed by coupling the pipe module into which the extension spring is inserted with the upper coupler and the lower coupler is relatively high in the whole height of the installed automatic tent, and contrarily, the height of the internal space of the automatic tent is not relatively high, which causes many inconveniences in standing or moving in the interior of the automatic tent.

According to the present invention, as shown in FIGS. 4 and 6, when the extension spring 400 is contracted, the second fastening member p is inserted into the long slots h formed on the lower end periphery of the small diameter pipe 110, and in this case, the lower end periphery of the small diameter pipe 110 is brought into contact with the bottom surface of the lower coupler 300, thus reducing the length of the pipe module 100 and further upwardly lifting the outer surface 2 of the automatic tent by the reduced length to ensure the interior of the automatic tent by a maximum height. Accordingly, the internal space of the automatic tent becomes enlarged to provide very pleasant camping.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An automatic tent frame comprising:

a pipe module 100 having a small diameter pipe 110 and a large diameter pipe 120 having different diameters from each other, the small diameter pipe 110 being insertedly fitted to the large diameter pipe 120 in such a manner as to be slidingly moved therein;

an upper coupler 200 having a small diameter pipe coupling groove 220 formed at the center of the underside thereof in such a manner as to be located on top of the pipe module 100 and coupled to the upper end periphery of the small diameter pipe 110 by means of a first fastening member (p);

a lower coupler 300 having a large diameter pipe coupling groove 340 formed at the center of the top thereof and a through hole 330 formed at the center of the underside thereof in such a manner as to be located on the underside of the pipe module 100 and coupled to the lower end periphery of the large diameter pipe 120 by means of a second fastening member (p);

an extension spring 400 having an upper coupling end 410 and a lower coupling end 420 on which fastening holes 411 and 421 are formed, an extension piece 423 exposed to the outside through the through hole 330 of the lower coupler 300 in such a manner as to be pulled by a given length when the extension spring 400 is fixed, the upper end periphery of the extension spring 400 being insertedly fitted to the pipe module 100 in such a manner as to be fixed to the small diameter pipe 110 by means of the first fastening member (p) passed through the upper coupler 200 and the small diameter pipe 110 to which the upper coupler 200 is fixed and inserted into the fastening hole 411 of the upper coupling end 410, and the lower end periphery of the extension spring 400 being insertedly fitted to the pipe module 100 in such a manner as to be fixed to the large diameter pipe 120 by means of the second fastening member (p) passed through the lower coupler 300 and the large diameter pipe 120 to which the lower coupler 300 is fixed and inserted into the fastening hole 421 of the lower coupling end 420;

a plurality of main poles 500 hinge-coupled to the upper coupler 200; and a plurality of support poles 600 each having one end hinge-coupled to the main pole 500 and the other end hinge-coupled to the lower coupler 300, wherein the small diameter pipe 110 is open on the top and bottom thereof and has coupling holes 111 formed facingly on the upper periphery thereof and long slots (h)

formed facingly on the lower end periphery thereof in a perpendicular direction to the coupling holes 111.

2. The automatic tent frame according to claim 1, wherein each long slot (h) has a given width through which the second fastening member (p) is passed and a given length extended from the underside of the small diameter pipe 110 to a higher position than the position where coupling holes 311 are formed on the lower coupler 300 to face the long slots (h) when the small diameter pipe 110 is coupled to the lower coupler 300.

3. The automatic tent frame according to claim 1, wherein the extension piece 423 exposed to the outside through the through hole 330 of the lower coupler 300 is coupled to an upper loop 22 disposed on the top of an outer surface 2 of an automatic tent in such a manner as to be pulled together when the extension spring 400 is contracted to increase a height of the automatic tent.

4. The automatic tent frame according to claim 1, wherein the small diameter pipe 110 and the upper coupler 200 are formed unitarily with each other, and the large diameter pipe 120 and the lower coupler 300 are formed unitarily with each other.

* * * * *